US008801126B2

(12) United States Patent
Karasawa et al.

(10) Patent No.: US 8,801,126 B2
(45) Date of Patent: Aug. 12, 2014

(54) LIQUID DETECTION SYSTEM, LIQUID CONTAINER, MOUNTING MEMBER, AND LIQUID SUPPLY SYSTEM

(75) Inventors: Masahiro Karasawa, Matsumoto (JP); Yuji Aoki, Matusmoto (JP); Masaru Takahashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 128 days.

(21) Appl. No.: 13/330,588

(22) Filed: Dec. 19, 2011

(65) Prior Publication Data

US 2012/0212526 A1 Aug. 23, 2012

(30) Foreign Application Priority Data

Dec. 22, 2010 (JP) ..... 2010-285972
Oct. 12, 2011 (JP) ..... 2011-231414

(51) Int. Cl.
*B41J 2/195* (2006.01)
*B41J 2/17* (2006.01)
*B41J 2/175* (2006.01)

(52) U.S. Cl.
USPC ..... 347/7; 347/84; 347/86

(58) Field of Classification Search
USPC ..... 347/7, 19, 84, 86
See application file for complete search history.

(56) References Cited

U.S. PATENT DOCUMENTS 4,604,633 A 8/1986 Kimura et al.
6,808,245 B2 10/2004 Katayama
7,404,628 B2 7/2008 Naka et al.
2005/0151764 A1 7/2005 Grady et al.
2007/0040859 A1 2/2007 Kimura
2007/0243104 A1* 10/2007 Aoki et al. ..... 422/58
2008/0316249 A1* 12/2008 Aoki et al. ..... 347/19
2009/0102880 A1* 4/2009 Kimura ..... 347/19
2009/0213159 A1 8/2009 Aoki et al.

FOREIGN PATENT DOCUMENTS

CN 201645998 U * 11/2010
EP 2272675 A2 * 1/2011
JP 60-22346 U 2/1985
JP 01-18356 Y2 5/1989
JP 2004-268519 A 9/2004
JP 2005-022257 A 1/2005
JP 2007-076363 A 3/2007
JP 2007-136807 A 6/2007
JP 2007-307894 A 11/2007
JP 2008-155596 A 7/2008
WO 2006/052034 A1 5/2006

* cited by examiner

*Primary Examiner* — Sarah Al Hashimi
(74) *Attorney, Agent, or Firm* — Kilpatrick Townsend & Stockton LLP

(57) ABSTRACT

A liquid chamber receives liquid flows from a liquid receiving unit. A first urging member urges a deforming portion of the liquid chamber. A lever provided on the liquid container side increases the displacement of the deforming portion. A sensor detects the displacement. A transmitting member transmits the increased displacement to the sensor. A second urging member provided on a liquid consuming apparatus side urges the transmitting member. When the liquid container is installed in the liquid consuming apparatus, the transmitting member comes in contact with the lever member due to the urging force of the second urging member, and the lever member is pushed against the deforming portion. In this manner, it is possible to divide the liquid detection system into the liquid consuming apparatus side and the liquid container side.

9 Claims, 10 Drawing Sheets

LIQUID DETECTION SYSTEM, LIQUID CONTAINER, MOUNTING MEMBER, AND LIQUID SUPPLY SYSTEM

This application claims priority to Japanese Patent Application No. 2010-285972, filed Dec. 22, 2011 and Japanese Patent Application No. 2011-231414, filed Oct. 21, 2011, the entireties of both of which are incorporated by reference herein.

BACKGROUND

1. Technical Field

The present invention relates to a technology which detects the presence or absence of liquid in a liquid container which supplies liquid to a liquid consuming apparatus.

2. Related Art

As an example of a liquid consuming apparatus, a so-called ink jet printer is known which prints images or the like by ejecting liquid, such as ink, from an ejection head. The liquid which is ejected from the ejection head is received in a dedicated liquid container such as liquid cartridge or the like, and is supplied to the ejection head through a connecting tube or the like. In addition, in general, when the liquid in a liquid cartridge runs out, each cartridge is replaced with a new cartridge.

In such a liquid consuming apparatus, there is a concern that the ejection head may be damaged when the liquid in the liquid cartridge runs out, and an ejection operation is performed in a state where the liquid is not supplied to the ejection head. Accordingly, a cartridge is proposed (JP-A-2007-307894) in which a detection system is mounted which detects that the liquid in the liquid cartridge has run out. Since the detection system is installed in the liquid cartridge itself, it is possible to rapidly detect that the liquid in the cartridge has run out.

In addition, various systems which detect the depletion of the liquid have been proposed. For example, a detection system has been proposed (JP-A-2007-136807) which detects a state where ink in a sub-tank is running out in the sub-tank which is installed in a carriage along with an ejection head, and to which ink is supplied through a tube from a main tank which is provided in a place where there is no movement other than the carriage. In the sub-tank, an opening portion of a case which has the opening portion on a wall surface is blocked by a deformable member which is flexible, and the deformable member is urged to the outside in a pressing manner by a compression spring from the inside of the case. In addition, a plate-like member (lever) is urged to the deformable member so as to come in contact with the deformable member, and the plate-like member (lever) rotates, following the deformable member which is drawn to the inside of the sub-tank due to a negative pressure in the sub-tank which is caused due to consumption of the ink. When a free end side of the plate-like member (lever) is detected along with the rotation using an optical sensor, it is determined that the ink in the sub-tank has run out, then a supply pump is operated to replenish ink to the sub-tank (JP-A-2007-136807).

Meanwhile, there was a problem in that when the detection system proposed in JP-A-2007-307894 is assumed to be installed in the liquid cartridge itself, the cost of the cartridge increases, since the expensive sensor is also replaced whenever the cartridge is replaced.

In addition, in a detection system which is proposed in JP-A-2007-136807, since the lever was directly detected using the sensor, there is a concern that the sensor is also contaminated when the lever which comes in contact with a diaphragm in the liquid chamber has liquid, such as ink, which is leaked attached thereto, and as a result, there is a concern that the accuracy of detecting that liquid has run out may deteriorate.

SUMMARY

An advantage of some aspects of the invention is to provide a technology which can prevent the detection accuracy of the sensor from deteriorating due to being contaminated with liquid, without increasing the cost of a cartridge-type liquid container.

According to an aspect of the invention, there is provided a liquid detection system which detects the presence or absence of liquid in a liquid container which is detachably mounted with respect to a liquid consuming apparatus, wherein the liquid container includes, a liquid receiving unit which can receive liquid which is consumed in the liquid consuming apparatus; a liquid chamber into which the liquid flows from the liquid receiving unit, and has a deforming portion which can deform at a part thereof; a first urging member which causes an urging force to be applied to the deforming portion, which is opposite to the deformation of the deforming portion due to a change in pressure of the liquid chamber which accompanies the supply of the liquid to the liquid consuming apparatus; and a lever member which is rotatably provided about a fulcrum, increases the displacement of the deforming portion which comes in contact with a first contact point at a predetermined lever ratio, and transmits the displacement to a second contact point, and wherein the liquid consuming apparatus includes, a transmitting member which comes in contact with the second contact point of the lever member, and transmits a displacement of the second contact point to the inside of the liquid consuming apparatus; a sensor which detects the presence or absence of the liquid in the liquid container by detecting the displacement which is transmitted using the transmitting member; and a second urging member which urges the transmitting member in the direction where the transmitting member comes in contact with the lever member, and presses the lever member against the deforming portion using the urging, when the liquid container is installed in the liquid consuming apparatus.

In such a liquid detection system according to the aspect of the invention, a deforming portion is provided, which can deform at a part of a liquid chamber to which the liquid flows in from a liquid receiving unit of a liquid container. An urging force of a first urging member is applied to the deforming portion which is opposite to the deformation of the deforming portion due to a change in pressure of the liquid chamber which accompanies supplying of the liquid to the liquid consuming apparatus. If the liquid in the liquid receiving unit runs out, the deforming portion deforms due to a change in pressure of the liquid in the liquid chamber, and a displacement of the deforming portion is increased at a predetermined lever ratio using the lever member. In addition, since the transmitting member which comes in contact with the lever member by being urged using the second urging member transmits the increased displacement to the sensor, the sensor can detect the presence or absence of the liquid in the liquid container by detecting the displacement which is transmitted using the transmitting member. In addition, in the liquid detection system according to the aspect of the invention, the transmitting member, the second urging member, and the sensor are provided on the liquid consuming apparatus side, in contrast to the liquid receiving unit, the liquid chamber, the first urging member, and the lever member which are provided on the liquid container side. When the liquid container is installed in the liquid consuming apparatus, the transmitting member comes in contact with the lever member using the urging force of the second urging member, and presses the lever member against the deforming portion.

According to the above described configuration, since the liquid detection system can be divided into the liquid consuming apparatus side and the liquid container side, and the liquid container can be replaced separately from the sensor which is provided inside the liquid consuming apparatus, it may be possible to reduce the cost of the liquid container compared to a case where the sensor is integrally provided in the liquid container. On the other hand, since it is possible to arrange the liquid chamber of which deforming portion deforms reflecting that the liquid in the liquid receiving unit has run out, or the lever member which increases the displacement of the deforming portion in the vicinity of the liquid receiving unit by providing on the liquid container side, it is possible to immediately detect that the liquid in the liquid receiving unit of the liquid container has run out.

In addition, the transmitting member is urged in the direction where the transmitting member comes in contact with the lever member using a force of the second urging member, and the lever member is pressed against the deforming portion of the liquid chamber using the urging force. In this manner, it may be possible to simplify the configuration of the liquid detection system which can be divided into the liquid consuming apparatus side and the liquid container side, since it is not necessary to separately provide the urging member which urges the lever member so as to rotate according to the deformation of the deforming portion of the liquid chamber.

In addition, in the liquid detection system according to the aspect of the invention, since the displacement which is transmitted using the transmitting member is detected, without directly detecting the displacement of the lever member by the sensor, it is possible to prevent the detection accuracy of the sensor from being deteriorated. That is, there is a case where the lever member which comes in contact with the displacement portion of the liquid chamber is attached with liquid which is leaked. Therefore, if the displacement of the lever member is transmitted to the sensor using the transmitting member, it is possible to reduce the risk of the sensor being contaminated with liquid which is attached to the lever member, compared to a case where the lever member is directly detected using the sensor. As a result, it is possible to prevent the detection accuracy of the sensor from being deteriorated.

Further, when mounting a new liquid container on the liquid consuming apparatus, the transmitting member moves against the urging force of the second urging member by being in contact with the lever member. For this reason, it may be possible to detect whether or not the new liquid container is mounted by detecting the displacement of the transmitting member at that time. In this manner, since it is possible to use one sensor not only when detecting the presence or absence of the liquid in the liquid container, but also when detecting whether or not the liquid container is mounted, it is possible to simplify the configuration of the liquid consuming apparatus on which the liquid detection system is mounted as a whole.

The above described liquid container may include a guide unit which guides the lever member when the lever member rotates due to the displacement of the deforming portion.

In this manner, since the rotating operation of the lever member is regulated by the guide unit, it is possible to appropriately increase the displacement of the deforming portion which comes in contact with the first contact point of the lever member at a predetermined lever ratio, and to reliably transmit the displacement to the transmitting member which comes in contact with the second contact point. As a result, it is possible to increase the accuracy for detecting the presence or absence of the liquid in the liquid container using the liquid detection system.

In addition, such a liquid detection system according to the aspect of the invention may be configured as follows. First, the first urging member urges the deforming portion of the liquid chamber in the direction where the deforming portion comes in contact with the lever member, and causes the lever member to rotate in the direction opposite to the second urging member using the urging force. Further, the urging force of the first urging member may be set to be larger than the urging force of the second urging member.

According to such a configuration, it is possible to cause the lever member to rotate against the urging force of the second urging member using the urging force of the first urging member so as to maintain the state (a state where the lever member is open) when there is liquid in the liquid receiving unit. On the other hand, when the liquid in the liquid container has run out, and the pressure of the liquid in the liquid container changes, the deforming portion deforms against the urging force of the first urging member, it is possible to cause the lever member to rotate according to the deformation of the deforming portion using the urging force of the second urging member, and to maintain the state (the state where the lever member is closed).

In the above described liquid detection system according to the aspect of the invention, in particular, the ratio of the urging force of the first urging member with respect to the urging force of the second urging member may be set to the predetermined lever ratio or more of the lever member.

According to another aspect of the invention, there is provided a liquid container which is detachably mounted with respect to a liquid consuming apparatus, including: a liquid receiving unit which can receive liquid which is consumed in the liquid consuming apparatus; a liquid chamber into which liquid flows from the liquid receiving unit, and has a deforming portion which can deform at a part thereof; a first urging member which causes an urging force to be applied to the deforming portion, which is opposite to a deformation of the deforming portion due to a change in pressure of the liquid chamber which accompanies a supply of liquid to the liquid consuming apparatus; and a lever member which is provided to be rotatable about a fulcrum, wherein the lever member comes in contact with a transmitting member which is provided in the liquid consuming apparatus, and of which displacement can be detected using a sensor which is provided in the liquid consuming apparatus, and has a second contact point in which a displacement of the deforming portion which comes in contact with a first contact point of the lever member is increased at a predetermined lever ratio, when being installed in the liquid consuming apparatus.

When the liquid container with such a configuration is used by being installed in a liquid ejecting device relating to the above described liquid detection system, the liquid ejecting device can obtain the same effect as that of the above described liquid detection system.

In the above described liquid container, a through hole may be provided, which guides the transmitting member of the above described liquid consuming apparatus to the second contact point.

In this manner, it is possible to guide the transmitting member of the liquid consuming apparatus using the through hole, and to improve the detection accuracy.

According to still another aspect of the invention, there is provided a mounting member which is detachably mounted with respect to a the liquid consuming apparatus, including: a liquid chamber into which liquid flows from outside, and has a deforming portion which can deform at a part thereof; a first urging member which causes an urging force to be applied to the deforming portion, which is opposite to a deformation of the deforming portion due to a change in pressure of the liquid chamber which accompanies a supply of the liquid to the liquid consuming apparatus; and a lever member which is provided to be rotatable about a fulcrum, increases the displacement of the deforming portion which comes in contact with a first contact point at a predetermined lever ratio, and transmits the displacement to a second contact point, wherein the lever member comes in contact with a transmitting member which is provided in the liquid consuming apparatus, and of which the displacement can be detected using a sensor which is provided in the liquid consuming apparatus, and has a second contact point in which a displacement of the deforming portion which comes in contact with the first contact point of the lever member is increased at a predetermined lever ratio, when being installed in the liquid consuming apparatus.

With such a configuration, it is possible to obtain the same effect as that of the above described liquid container.

The above described mounting member may include a connecting unit to which a liquid transport pipe is connected, which transports liquid flowing into the liquid chamber from the outside. By providing the connecting unit, it becomes easy to connect the liquid transport pipe.

According to still another aspect of the invention, there is provided a liquid supply system which is configured using the above described mounting member, including: a liquid storage unit; a liquid transport pipe which is connected to the liquid storage unit, and transports liquid which is stored in the liquid storage unit; and above described mounting member which is connected to the liquid transport pipe.

With such a configuration, it is possible to obtain the same effect as that of the above described liquid detection system and the liquid container, in the aspect in which liquid is supplied to the liquid consuming apparatus through the liquid supply pipe from the liquid storage unit which is provided outside of the liquid consuming apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in order to clarify the above described contents of the invention according to the following order.

A. First Embodiment
A-1. Configuration of Ink Jet Printer
A-2. Configuration of Ink Cartridge
A-3. Configuration of Rod and Sensor
A-4. Detection of Presence or Absence of Ink in Ink Cartridge
B. Second Embodiment

A. First Embodiment

A-1. Configuration of Ink Jet Printer

Figure 1:
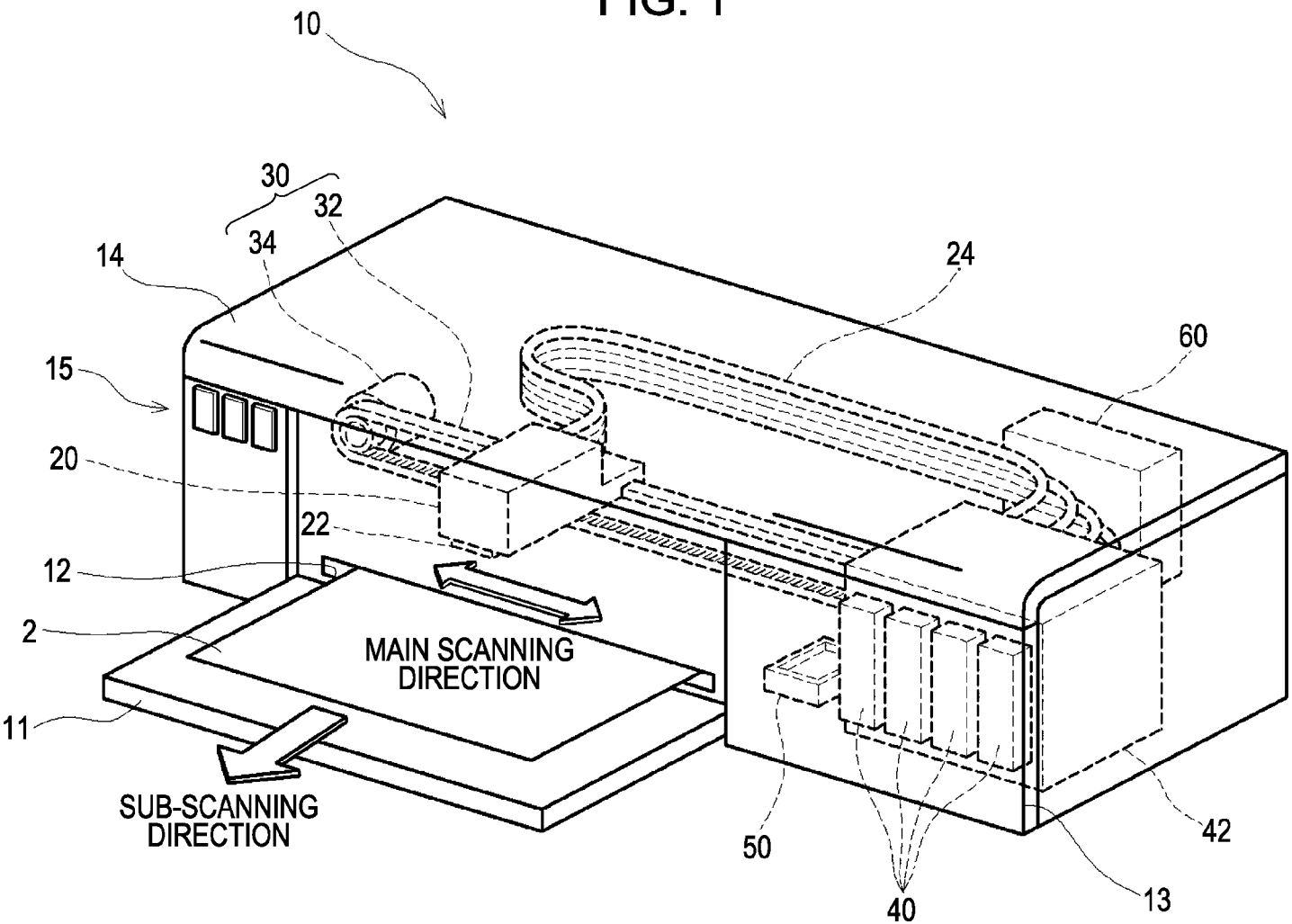
FIG. 1 is an explanatory diagram which shows a schematic configuration of a liquid consuming apparatus according to an embodiment using a so-called ink jet printer as an example.

FIG. 1 is an explanatory diagram which shows a schematic configuration of a liquid consuming apparatus according to a first embodiment of the invention using a so-called ink jet printer as an example. An ink jet printer 10 which is shown has an approximately box shaped appearance, a front cover 11 is provided approximately in the center of the front surface thereof, and a plurality of operation buttons 15 are provided on the immediate left thereof. The front cover 11 is axially supported at the bottom end side, and a thin and long sheet discharge port 12 from which a printing sheet 2 as a printing medium is discharged appears when the upper end of the front cover is pulled down to the front. In addition, a sheet feeding tray (not shown) is provided in the rear surface side of the ink jet printer 10. When the printing sheet 2 is set in the sheet feeding tray, and the operation button 15 is operated, the printing sheet 2 is fed from the sheet feeding tray, and an image or the like is printed on the front surface of the printing sheet 2 inside thereof, then finally the printing sheet 2 is discharged from the sheet discharge port 12.

In addition, a top cover 14 is provided on the top surface side of the ink jet printer 10. The top cover 14 is axially supported at the depth side, and it is possible to check the inside of the ink jet printer 10, or perform repairing of the ink jet printer 10 by holding up the front side and opening the top cover 14.

A carriage 20 which forms ink dots on the printing sheet 2 while reciprocating in the main scanning direction, a driving mechanism 30 which causes the carriage 20 to reciprocate, or the like is provided in the ink jet printer 10. An ejecting head 22 in which a plurality of ejecting nozzles is formed is installed in the bottom surface side (a side facing the printing sheet 2) of the carriage 20, and printing of images or the like is performed by ejecting ink toward the printing sheet 2 from the ejecting nozzles. The ink jet printer 10 according to the embodiment can perform printing of color images using four types of ink of cyan, magenta, yellow, and black, and corresponding to this, the ejecting head 22 which is installed in the carriage 20 is provided with ejecting nozzles for each type of ink.

The ink which is ejected from the ejecting nozzle formed in the ejecting head 22 is received in a dedicated container which is referred to as an ink cartridge 40. The ink cartridge 40 is installed in a cartridge holder 42 which is provided at a position which is separated from the carriage 20, and the ink in the ink cartridge 40 is supplied to the ejecting head 22 of the carriage 20 through the cartridge holder 42 and an ink tube 24. The ink jet printer 10 according to the embodiment is provided with a cartridge replacement cover 13 which is axially supported at the bottom end side, similarly to the front cover 11 on the immediate right of the front cover 11, and when the upper end side of the cartridge replacement cover 13 is pulled down to the front, the cartridge holder 42 appears, and it is possible to attach or detach the ink cartridge 40. The state where the ink cartridge 40 is installed in the cartridge holder 42, and a detailed configuration of the ink cartridge 40 will be described later using separate drawings.

In addition, in the ink jet printer 10 according to the embodiment, the ink cartridge 40 is provided for each type of ink, as well, since four types of ink of cyan, magenta, yellow, and black are used. Each of ink in the ink cartridge is supplied to the corresponding ejecting nozzle of the ejecting head 22 through the ink tube 24 which is provided for each type of ink.

A driving mechanism 30 which causes the carriage 20 to reciprocate is configured by a timing belt 32 inside of which a plurality of tooth shapes is formed, a driving motor 34 for driving the timing belt 32, or the like. A part of the timing belt 32 is fixed to the carriage 20, and when the timing belt 32 is driven, it is possible to make the carriage 20 reciprocate in the main scanning direction while guiding the carriage using a guide rail (not shown) which is extended in the main scanning direction.

In addition, a region which is referred to as a home position is provided at a position other than a printing region to which the carriage 20 is moved in the main scanning direction. A maintenance mechanism which performs maintenance for performing successful printing is installed in the home position. The maintenance mechanism pressed against a bottom surface side (a side facing the printing sheet 2) of the ejecting head 22 and a surface (nozzle surface) on which ejecting nozzles are formed, and is configured by a cap member 50 which forms an enclosed space so as to surround the ejecting nozzles, a lifting mechanism (not shown) which lifts the cap member 50 in order to press the cap member against the nozzle surface of the ejecting head 22, a suction pump (not shown) which introduces a negative pressure to the enclosed space which is formed by pressing the cap member 50 against the nozzle surface of the ejecting head 22, or the like.

Further, a sheet sending mechanism (not shown) for sending the printing sheet 2, a control unit 60 which controls the entire operation of the ink jet printer 10, or the like is mounted as well, in the ink jet printer 10. An operation of causing the carriage 20 to reciprocate, an operation of sending the printing sheet 2, an operation of ejecting ink from the ejecting nozzle, an operation of executing a maintenance for successful printing, or the like are all controlled by the control unit 60.

Figure 2:
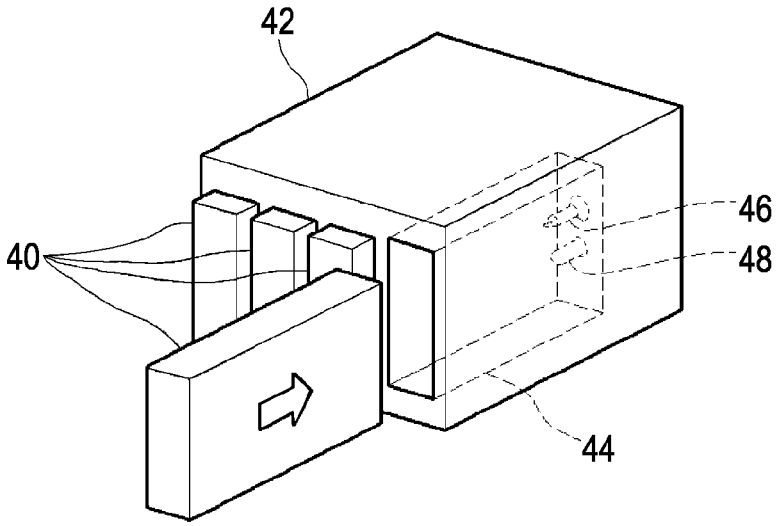
FIG. 2 is an explanatory diagram which shows a state where an ink cartridge is installed in a cartridge holder.

FIG. 2 is an explanatory diagram which shows a state where the ink cartridge 40 is installed in the cartridge holder 42. As shown in the drawing, in the cartridge holder 42, an insertion hole 44 to which the ink cartridge 40 is inserted is provided for every ink cartridge 40 from the front side to the rear side. An ink input needle 46 which takes in ink from the ink cartridge 40 is erected on a surface of the rear side of the insertion hole 44 toward the front side. In addition, an ink supply port (not shown) is provided on the rear surface of the ink cartridge 40. When the ink cartridge 40 is inserted into the rear side, and is installed in the insertion hole 44 of the cartridge holder 42, the ink input needle 46 is inserted into the ink supply port, it is possible to take the ink in the ink cartridge 40 into the cartridge holder 42.

An ink path or a supply pump (not shown) is built into the ink jet printer 10. The ink which is taken in from the ink input needle 46 is guided to an ink tube 24 (refer to FIG. 1) which is connected to the rear surface side of the cartridge holder 42 through the ink path. In addition, the supply pump (for example, a diaphragm pump) which is provided on the way to the ink path sucks the ink in the ink cartridge 40, and sends the ink toward a sub-tank (not shown) which is provided in the carriage 20, in a compressing manner. In addition, as described above, the ink jet printer 10 according to the embodiment is installed with the ink cartridges 40 for four colors of cyan, magenta, yellow, and black, and the ink in the ink cartridges 40 is supplied to the ejecting head 22, separately and respectively. For this reason, the ink path or the supply pump is separately provided for every ink cartridge 40, in the cartridge holder 42.

In addition, a rod 48 protrudes from a surface on the rear side of the insertion hole 44 of the cartridge holder 42 toward the front side. To be described in detail later, a sensor for detecting the presence or absence of the ink in the ink cartridge 40 is provided in the cartridge holder 42, and the rod 48 plays a role of transmitting the state in the ink cartridge 40 to the sensor. Further, the configuration of the rod 48 and the sensor will be described in detail later.

A-2. Configuration of Ink Cartridge

Figure 3:
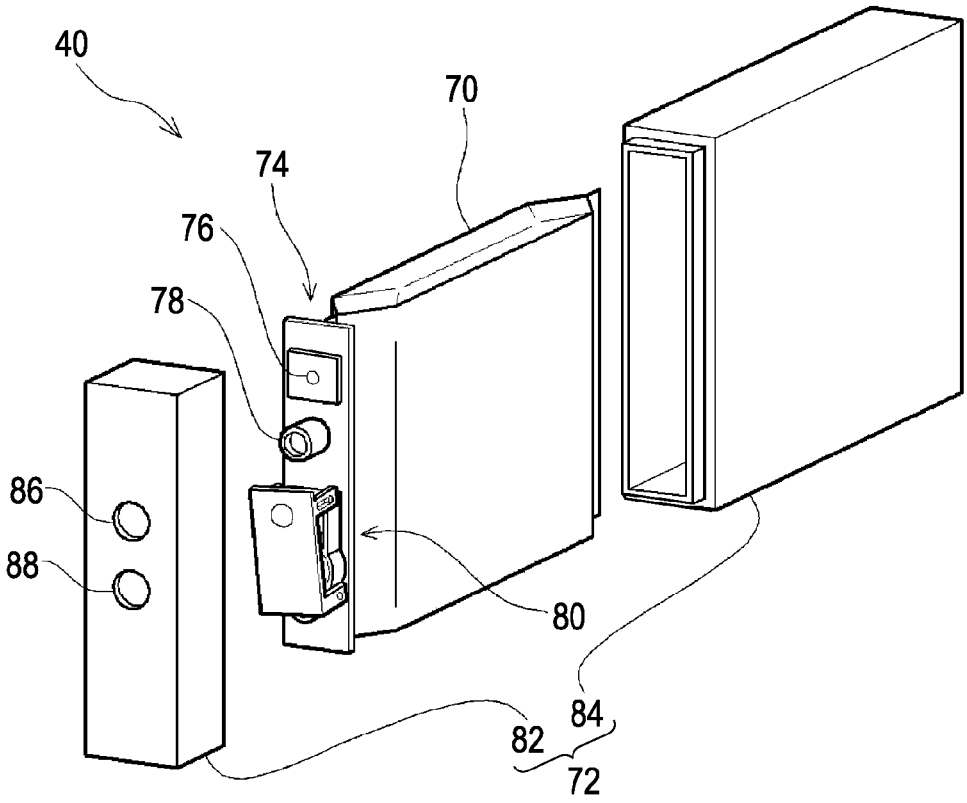
FIG. 3 is an exploded perspective view which shows a configuration of the ink cartridge according to the first embodiment.

FIG. 3 is an exploded perspective view which shows a configuration of the ink cartridge 40 according to the embodiment. As shown in the drawing, the ink cartridge 40 is configured by an ink pack 70 which receives ink, a cartridge case 72 which receives the ink pack 70, or the like. The ink pack 70 is formed such that a film which is impervious to liquid such as ink or the like is bonded together in a pouch shape, and an opening portion of the pouch is enclosed by interposing an ink supply unit 74 therebetween. In addition, the ink cartridge 40 according to the embodiment corresponds to "the liquid container" of the invention, and the ink pack 70 according to the embodiment corresponds to "the ink receiving unit" of the invention.

An ink inlet 76 for filling the ink into the ink pack 70 in a manufacturing process of the ink cartridge 40, the ink supply port 78 into which the above described ink input needle 46 on the cartridge holder 42 is inserted, an ink detection mechanism 80 for detecting the presence or absence of the ink in the ink pack 70, or the like is provided in the ink supply unit 74. In addition, a detailed configuration of the ink detection mechanism 80 will be described later.

The cartridge case 72 for receiving the ink pack 70 is configured by the front case 82 and the rear case 84. The rear case 84 is formed in a box shape, and is able to receive the pouch portion of the ink pack 70 in the inside. Meanwhile, the front case 82 is a member which covers the ink supply unit 74 of the ink pack 70, and encloses the opening portion (put a lid on) by being fitted with the rear case 84. In addition, a through hole 86 for input needle into which the ink input needle 46 on the cartridge holder 42 side is inserted when installing the ink cartridge 40 in the cartridge holder 42, and a through hole 88 for the rod into which the rod 48 is inserted are provided in the front case 82.

Figure 4:
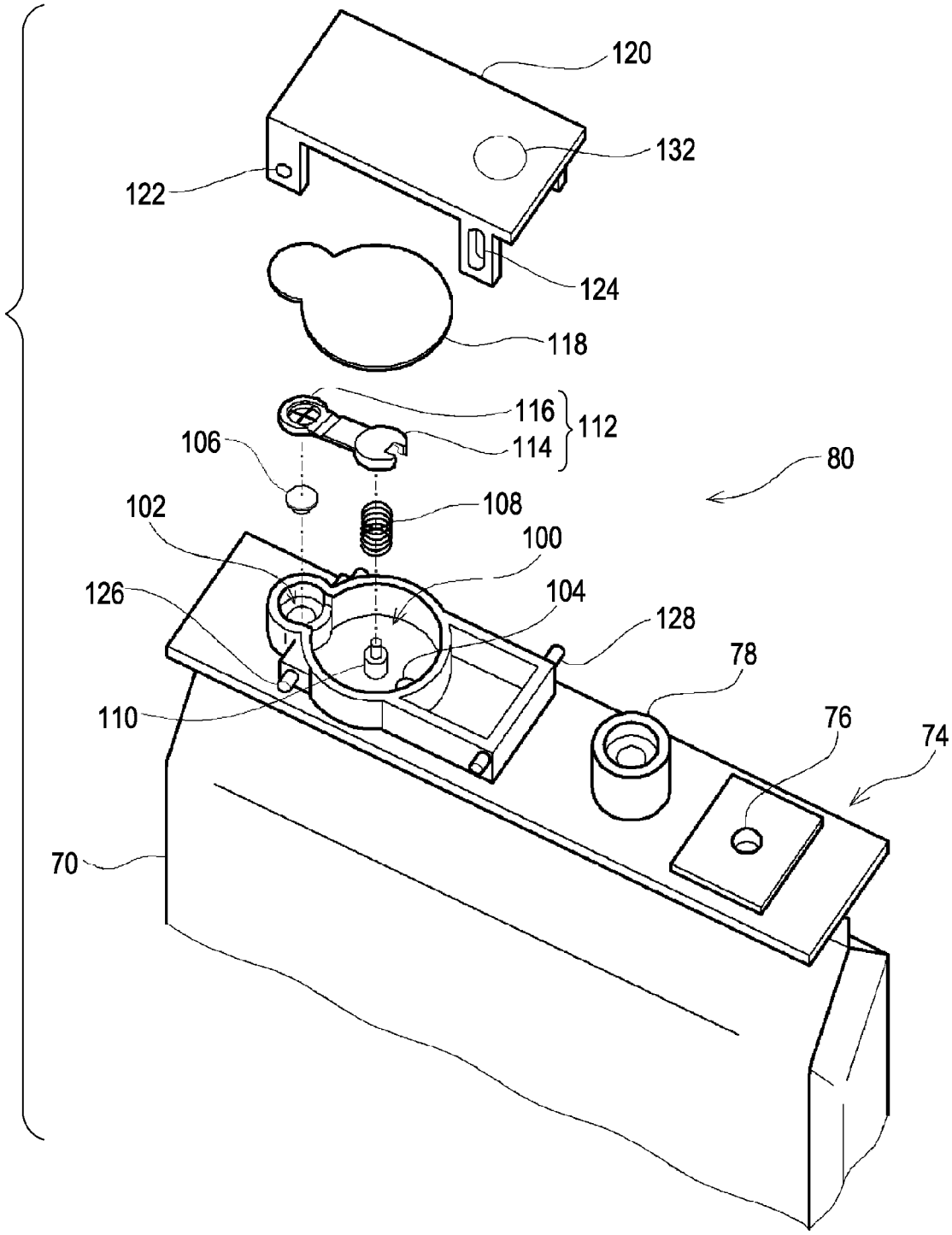
FIG. 4 is an exploded perspective view which shows a configuration of an ink detection mechanism which is installed in the ink cartridge according to the first embodiment.

FIG. 4 is an exploded perspective view which shows a configuration of the ink detection mechanism 80 which is installed in the ink cartridge 40 according to the embodiment. In addition, FIG. 4 shows the ink detection mechanism 80 of the ink pack 70 which is seen from the top, in a state where the ink supply port 78 is caused to face vertically upward. As shown in the drawing, a liquid chamber 100 of an approximately cylindrical shape is provided in the ink detection mechanism 80, and in the liquid chamber 100, an inlet 102 to which the ink in the ink pack 70 flows in, or an outlet 104 from which the ink flow out toward the ink supply port 78 is open. In addition, the upper end surface of the liquid chamber 100 is covered with a film 118 which is formed of a flexible material.

A check valve 106 which prevents the ink, which has flowed into the liquid chamber 100 from the inlet 102, from flowing back, an urging spring 108 which urges the film 118 toward the outside of the liquid chamber 100, or the like is provided in the liquid chamber 100. The urging spring 108 fits with the protrusion 110 which is erected from the bottom of the liquid chamber 100 to the upper side, is positioned, and is provided in a compressed state. In addition, a pressure receiving plate 112 is inserted between the urging spring 108 and the film 118. The pressure receiving plate 112 is integrally configured by connecting a pressure receiving unit 114 which transmits the urging force of the urging spring 108 to the film 118 and a regulation unit 116 which regulates the movement of the check valve 106. If the regulation unit 116 of the pressure receiving plate 112 is fitted into the inlet 102 of the liquid chamber 100, movement upward of the check valve 106 is regulated, and the pressure receiving unit 114 is positioned in a state where the pressure receiving unit 114 is interposed between the urging spring 108 and the film 118. In addition, according to the embodiment, the pressure receiving unit 114 and the regulation unit 116 are integrally configured, however, the pressure receiving unit and the regulation unit may be separately configured.

In addition, a lever member 120 which comes in contact with the film 118 which configures one end surface of the liquid chamber 100 (upper end surface in the drawing) from the outside of the liquid chamber 100 is provided. The lever member 120 is provided with a shaft hole 122 on one end side thereof, and is fitted with a shaft pin 126 which is provided on the outer side surface of the liquid chamber 100 so as to be axially supported in a rotatable manner. On the other hand, the other end side of the lever member 120 is provided with a guide hole 124, and a guide pin 128 which is fixed to the ink supply unit 74 is inserted through the guide hole 124, thereby guiding the rotation operation of the lever member 120. In addition, a convex portion as a contact portion 132 with which the above described rod 48 on the cartridge holder 42 side comes in contact is provided on the top surface (the opposite surface to a surface which comes in contact with the film 118) of the lever member 120. In the ink pack 70 which includes the ink detection mechanism 80 with such a configuration, the ink in the ink pack 70 is supplied to the cartridge holder 42 as in the following manner.

Figure 5A:
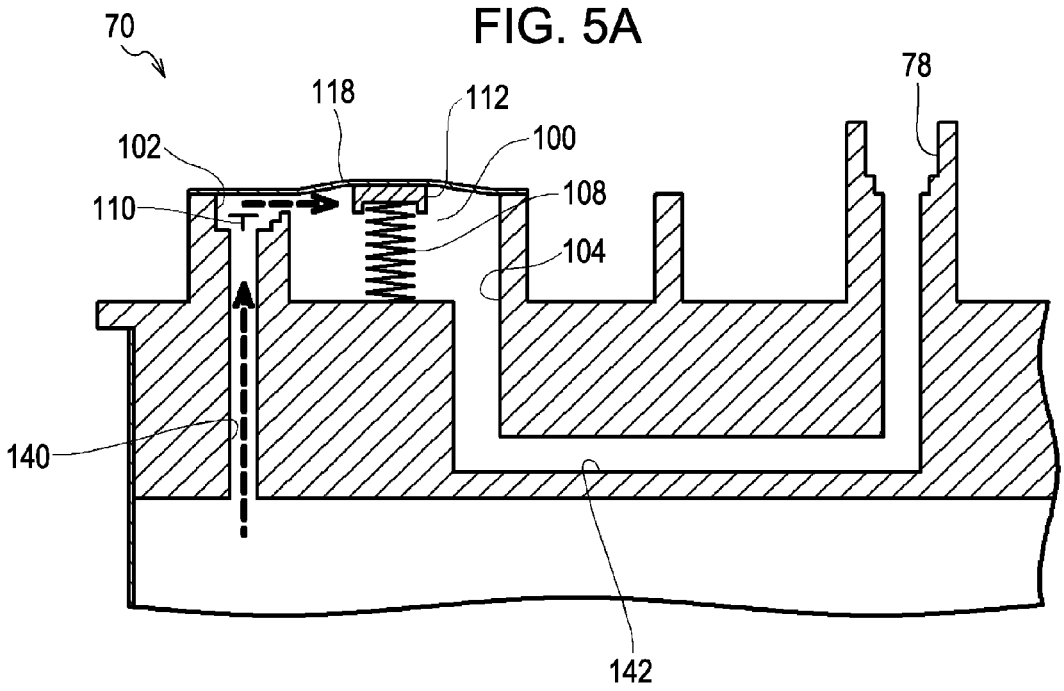
FIGS. 5A and 5B are cross-sectional views which show a state where ink in the ink pack is supplied to an ink jet printer.
Figure 5B:
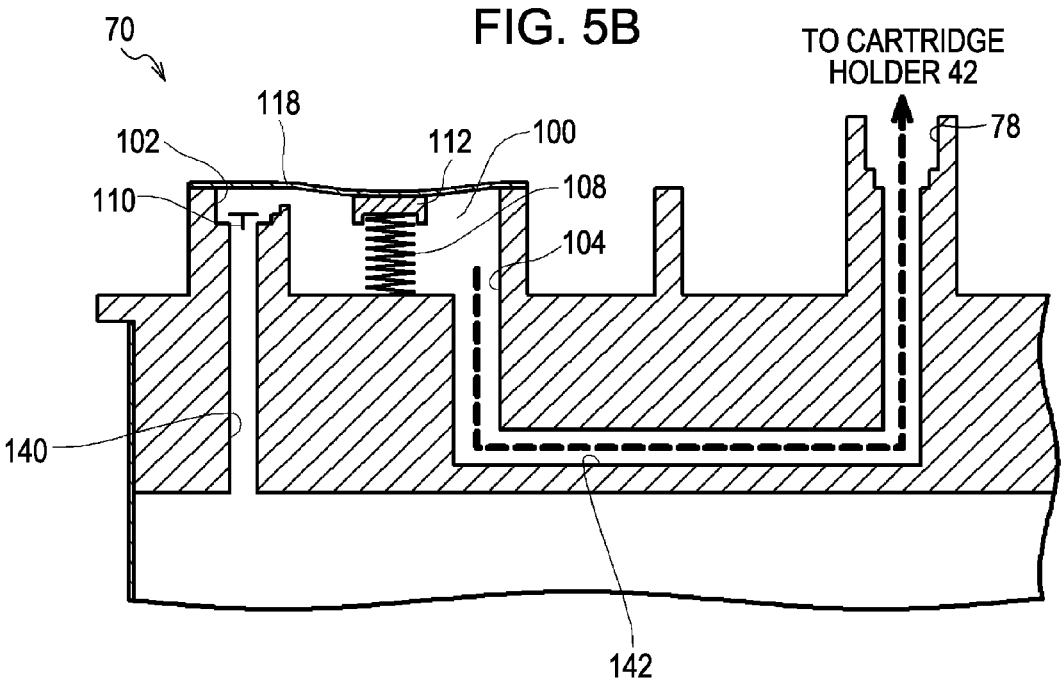

FIGS. 5A and 5B are cross-sectional views which show a state where the ink in the ink pack 70 is supplied to the ink jet printer 10. In addition, in FIGS. 5A and 5B, the lever member 120, the regulation unit 116 of the pressure receiving plate 112, or the like is not shown in the drawings for simplifying the drawing. As described above, a supply pump (not shown) is built into the ink jet printer 10, the ink is sucked from the ink cartridge 40 side, and is sent toward the carriage 20 in a compressing manner. FIG. 5A shows a state where the supply pump of the ink jet printer 10 is not operated, and FIG. 5B shows a state where the supply pump of the ink jet printer 10 is operated.

As described above, the urging spring 108 is provided in the liquid chamber 100, and the film 118 is urged to the outside of the liquid chamber 100. As shown in FIG. 5A, when the supply pump of the ink jet printer 10 is not operated, the urging spring 108 pushes the film 118 out in order to increase the volume of the liquid chamber 100, and the ink flows into the liquid chamber 100 through an inflow path 140 which connects the ink pack 70 and the inlet 102, along with the increase of the volume of the liquid chamber 100. The check valve 106 is provided in the inlet 102, and it is assumed to allow the ink to flow into the liquid chamber 100, and prevent the ink from flowing back. In addition, the dashed arrow in the drawing denotes the flow of the ink.

When the supply pump of the ink jet printer 10 is operated, the ink is sucked from the ink supply port 78, and the ink in the liquid chamber 100 is supplied to the cartridge holder 42 through an outflow path 142 which connects the outlet 104 and the ink supply port 78. In addition, since the inner diameter of the outflow path 142 is set to be larger than that of the inflow path 140, in the ink cartridge 40 according to the embodiment, the inflow of the ink to the liquid chamber 100 does not keep up with the outflow of the ink from the liquid chamber 100, accordingly, the inside of the liquid chamber 100 attains a negative pressure. For this reason, as shown in FIG. 5B, the film 118 deforms so as to be drawn into the liquid chamber 100, against the force of the urging spring 108.

The negative pressure generated in this liquid chamber 100 is gradually relieved when the ink in the ink pack 70 flows into the liquid chamber 100 through the inflow path 140. Then, the film 118 is pushed out to the outside of the liquid chamber 100 again and the volume of the liquid chamber 100 is restored due to the force of the urging spring 108, and returns to the state which is shown in FIG. 5A, after a predetermined time has passed from the stop of the supply pump of the ink jet printer 10. In addition, when the supply pump of the ink jet printer 10 is operated again, the inside of the liquid chamber 100 attains a negative pressure, and the film 118 is drawn into the liquid chamber 100 as shown in FIG. 5B. Further, the urging spring 108 according to the embodiment corresponds to "the first urging member" of the invention.

In this manner, when the ink in the ink pack 70 runs out during supplying the ink in the ink pack 70 to the cartridge holder 42 through the liquid chamber 100, since the ink does not flow into the liquid chamber 100 from the ink pack 70, even if it is the negative pressure in the liquid chamber 100, the negative pressure in the liquid chamber 100 is not relieved, even after a predetermined time has passed from the stop of the supply pump of the ink jet printer 10, and the film 118 maintains the state of being drawn into the liquid chamber 100 as shown in FIG. 5B.

In this manner, when the ink in the ink pack 70 runs out, since the film 118 which configures one end surface of the liquid chamber 100 maintains the deformed state of being drawn into the liquid chamber 100, in the ink cartridge 40 according to the embodiment, it is possible to detect that the ink in the ink pack 70 has run out by detecting such a displacement of the film 118. However, since the displacement of the film 118 according to the embodiment is small, the displacement is increased using the lever member 120 as follows.

Figure 6:
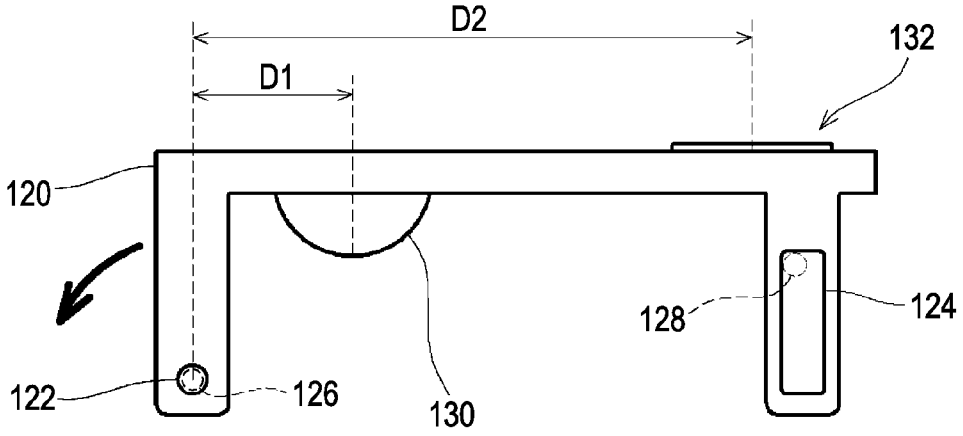
FIG. 6 is an explanatory diagram which show a configuration of a lever member which is provided in the ink cartridge according to the first embodiment.

FIG. 6 is an explanatory diagram which shows a configuration of the lever member 120 which is provided in the ink cartridge 40 according to the embodiment. As shown in the drawing, the shaft hole 122 is provided at one end side of the lever member 120, and the lever member 120 is able to rotate about the shaft hole 122 in a state where the shaft pin 126 (refer to FIG. 4) which is provided on the outer side surface of the liquid chamber 100 is fitted into the shaft hole 122. In addition, the other end side of the lever member 120 is provided with a guide hole 124, and a guide pin 128 (refer to FIG. 4) which is fixed to the ink supply unit 74 is inserted through the guide hole 124. When the lever member 120 rotates, since the rotating operation of the lever member 120 is guided by the movement of the guide pin 128 which moves along the guide hole 124, it is possible to regulate the rotation (displacement) of the lever member 120 with high precision. In addition, the guide hole 124 and the guide pin 128 according to the embodiment correspond to "the guide unit" in the application of the invention.

In addition, a convex portion 130 of a semi-spherical shape which comes in contact with the film 118 is provided on a surface of the lever member 120 which faces the film 118, and a contact portion 132 which is a convex portion with which the tip end of the rod 48 which is provided on the cartridge holder 42 comes in contact is provided on a surface on the opposite side to the side which faces the film 118 of the lever member 120. In addition, since the distance D2 from the shaft hole 122 as the fulcrum of the lever member 120 to the contact portion 132 is set to be larger than the distance D1 from the shaft hole 122 to the convex portion 130, if the film 118 which comes in contact with the convex portion 130 deforms, the displacement is increased at the lever ratio R (=D2/D1>1, and 3.1 according to the embodiment), and is transmitted to the contact portion 132. In this manner, the displacement of the film 118 which is increased in the lever member 120 is transferred to the sensor which is provided in the cartridge holder 42 using the rod 48, as described above.

A-3. Configuration of Rod and Sensor

Figure 7:
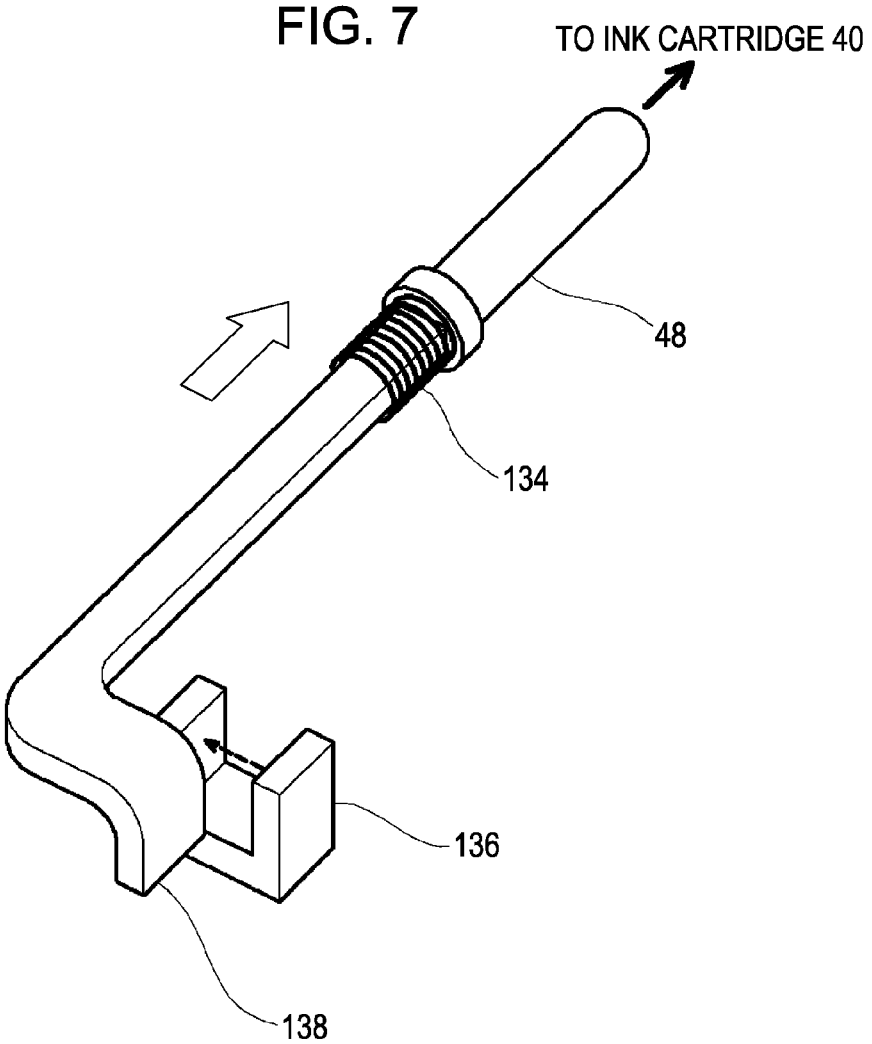
FIG. 7 is a perspective view which shows configurations of a rod and sensor which are provided on the cartridge holder according to the first embodiment.

FIG. 7 is a perspective view which shows a configuration of the rod 48 and a sensor 136 which are provided in the cartridge holder 42 according to the embodiment. In addition, FIG. 7 shows a state where the rod 48 and the sensor 136 are seen from the rear side of the cartridge holder 42 which is shown in FIG. 2. As shown in the drawing, an urging spring 134 is attached to the rod 48, and the rod 48 is urged toward the ink cartridge 40 (the direction of an outlined arrow in the drawing) which is installed in the cartridge holder 42. In addition, the rod 48 according to the embodiment corresponds to "the transmitting member", and the urging spring 134 according to the embodiment corresponds to "the second urging member" of the invention.

In addition, in the sensor 136 of the embodiment, a so-called transmission-type photosensor of a concave shape is used. A light emitting unit and a light receiving unit which are not shown are provided to face each other in the sensor 136, and light which is emitted from the light emitting unit is received in the light receiving unit. In addition, the dashed arrow in the drawing denotes the transmission direction of the light.

In addition, at an end portion on the opposite side to the side which faces the ink cartridge 40 of the rod 48 is provided with a light shielding unit 138. When the rod 48 moves to the ink cartridge 40 side due to the force of the urging spring 134, the light shielding unit 138 is inserted between the light emitting unit and the light receiving unit of the sensor 136, and the light from the light emitting unit is shielded. As a result, since the light receiving unit of the sensor 136 is unable to receive the light from the light emitting unit, it is possible to detect that the position of the rod 48 has changed. In addition, the transmission-type photosensor is used in the sensor 136 according to the embodiment, however, the sensor is not limited to the photosensor, if it is a sensor which can detect the displacement of the rod 48.

A-4. Detection of Presence or Absence of Ink in Ink Cartridge

Figure 8A:
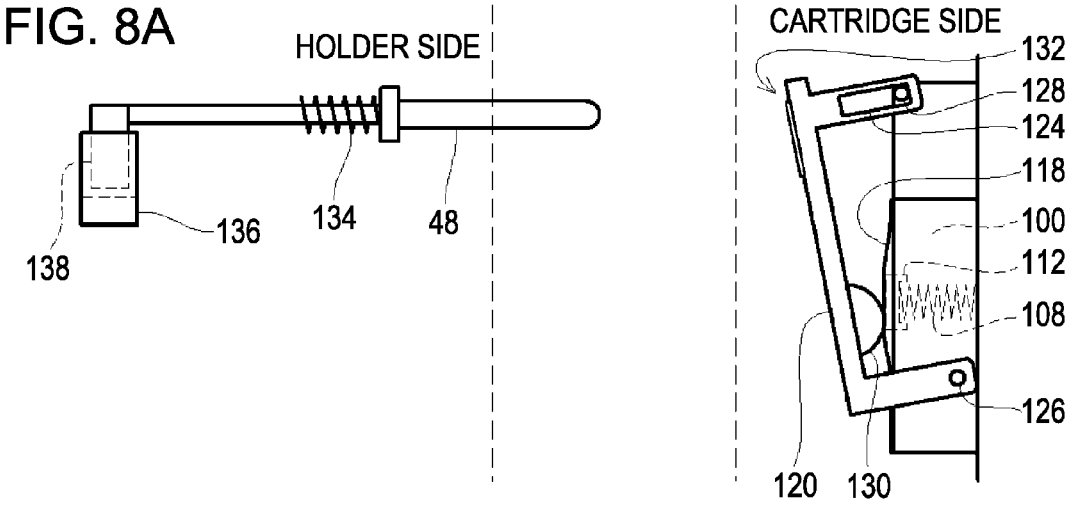
FIGS. 8A, 8B, and 8C are explanatory diagrams which show a state where the presence or absence of ink in the ink cartridge is detected using a sensor which is provided in the cartridge holder.
Figure 8B:
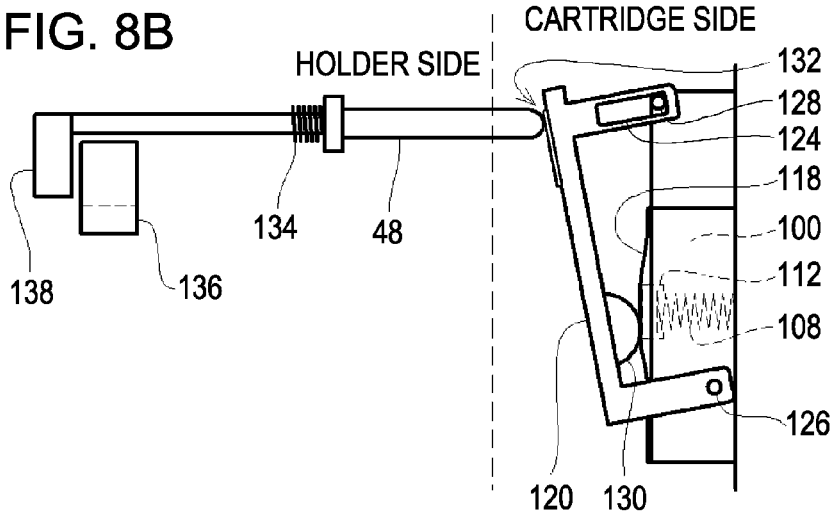
Figure 8C:
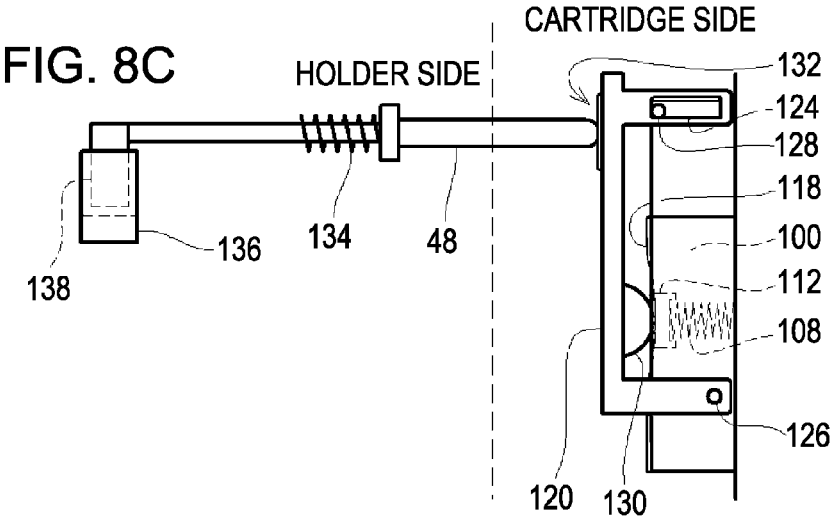

FIGS. 8A, 8B, and 8C are explanatory diagrams which show a state where the presence or absence of ink in the ink cartridge 40 is detected using the sensor 136 which is provided in the cartridge holder 42. First, FIG. 8A shows a state where the ink cartridge 40 is not yet installed in the cartridge holder 42. As described above, the urging spring 134 is attached to the rod 48 which is provided on the cartridge holder 42 side, and the rod 48 is urged toward the ink cartridge 40. Since the rod 48 moves to the ink cartridge 40 side due to the force of the urging spring 134 when the ink cartridge 40 is not installed, the light shielding unit 138 of the rod 48 is inserted between the light emitting unit and the light receiving unit of the sensor 136 (refer to FIG. 7), accordingly, it becomes a state where the light from the light emitting unit is shielded.

In addition, when the ink cartridge 40 is installed in the cartridge holder 42, as shown in FIG. 8B, the tip end of the rod 48 comes in contact with the contact portion 132 of the lever member 120 which is provided on the ink cartridge 40 side, and the rod 48 moves to the rear side of the cartridge holder 42 against the force of the urging spring 134. Then, the light shielding unit 138 of the rod 48 is separated from the sensor 136, accordingly, the sensor 136 is in a state where the light is transmitted. In this manner, the sensor 136 is able to detect that the ink cartridge 40 has installed, on the basis of the change from the shielded state to the transmission state of the light, due to the movement of the light shielding unit 138 of the rod 48.

Here, as described above, the lever member 120 on the ink cartridge 40 side with which the rod 48 comes in contact increases the displacement of the film 118 which configures one end surface of the liquid chamber 100 at a predetermined lever ratio R (=D2/D1>1, refer to FIG. 6), and transmits to the rod 48. In addition, the film 118 which comes in contact with the convex portion 130 of the lever member 120 is urged toward the outside of the liquid chamber 100, due to the urging spring 108 which is provided in the liquid chamber 100. In addition, according to the embodiment, the relationship between the urging force A of the urging spring 108 of the liquid chamber 100 and the urging force B of the urging spring 134 of the rod 48 is set to satisfy the expression $A \geq R \times B$. In this manner, since the urging force A of the urging spring 108 of the liquid chamber 100 is set to be larger than the urging force B of the urging spring 134 of the rod 48, as shown in FIG. 8B, the film 118 is pushed to the outside of the liquid chamber 100 due to the urging force A of the urging spring 108, and the lever member 120 maintains the open state. In addition, the rod 48 which comes in contact with the lever member 120 is in a state of being pushed back to the rear side of the cartridge holder 42 (a state where the light is transmitted by the sensor 136) against the urging force B of the urging spring 134.

In addition, as described above using FIGS. 5A and 5B, when the supply pump which is provided in the cartridge holder 42 is operated, and the ink is sucked in from the ink supply port 78 of the ink cartridge 40, the film 118 is deformed so as to be drawn into the liquid chamber 100 against the force of the urging spring 108, since the inside of the liquid chamber 100 attains a negative pressure. At this time, if the ink remains in the ink pack 70, the negative pressure in the liquid chamber 100 is relieved due to the ink which flows into the liquid chamber 100 from the ink pack 70, the film 118 pushed to the outside of the liquid chamber 100 again, and the sensor 136 is in a state of transmitting the light as shown in FIG. 8B, after a predetermined time has passed from the stop of the supply pump of the cartridge holder 42.

On the other hand, when the ink in the ink pack 70 has run out, since ink does not flow into the liquid chamber 100 from the ink pack 70, and the negative pressure in the liquid chamber 100 is not relieved, as shown in FIG. 8C, the film 118 is in a state of being drawn into the liquid chamber 100. The film 118 and the convex portion 130 of the lever member 120 are not bonded and fixed to each other, however, the rod 48 which is urged to the direction where the rod comes in contact with the lever member 120 due to the force of the urging spring 134 causes the lever member 120 to rotate according to the deformation of the film 118 using the urging force thereof, the lever member 120 maintains the closed state. In addition, the displacement of the film 118 which comes in contact with the convex portion 130 of the lever member 120 is small, however, the displacement is increased at a predetermined lever ratio R (=D2/D1>1, refer to FIG. 6) in the contact portion 132. As a result, since the rod 48 moves to the ink cartridge 40 side, and the light shielding unit 138 of the rod 48 is inserted into the sensor 136, the sensor 136 is in a state of shielding the light. In this manner, the sensor 136 is able to detect that the ink in the ink pack 70 has run out, on the basis of the fact that the light has shielded due to the light shielding unit 138 of the rod 48 (the rod 48 has moved).

In addition, as described above, there may be a case where the negative pressure in the liquid chamber 100 is not relieved even if ink remains in the ink pack 70, during the time from the stop of the supply pump of the ink jet printer 10 until a predetermined time has passed thereafter. For this reason, in the embodiment, after a predetermined time has passed from the stop of the supply pump, whether or not light in the sensor 136 has been shielded is detected.

As described above, in the ink jet printer 10 according to the embodiment, the liquid chamber 100 of which one end surface is formed of the film 118 or the lever member 120 which increases the displacement of the film 118 among the systems (liquid detection system) which detect that the ink in the ink cartridge 40 has run out is provided on the ink cartridge 40 side. On the contrary, the sensor 136 which detects the displacement or the rod 48 which transmits the displacement which is increased by the lever member 120 to the sensor 136 is provided on the cartridge holder 42 side, in which the rod 48 is urged in the direction where the rod comes in contact with the lever member 120 by the urging spring 134 when the ink cartridge 40 is installed in the cartridge holder 42. In this manner, it is possible to divide the liquid detection system into the cartridge holder 42 side and the ink cartridge 40 side. Accordingly, since it is possible to replace the ink cartridge 40 by separating from the expensive sensor 136 which is built into the cartridge holder 42, it is possible to reduce the cost of the ink cartridge 40, compared to the case where the sensor 136 is integrally provided to the ink cartridge 40. On the other hand, it is possible to provide the liquid chamber 100 in which the film 118 deforms when the ink in the ink pack 70 runs out and does not flow in, or the lever member 120 which increases the displacement of the film 118 on the ink cartridge 40 side, and to arrange the liquid chamber 100 and the lever member 120 in the vicinity of the ink pack 70. Accordingly, it is possible to immediately and without error detect that the ink in the ink pack 70 has run out.

In addition, the sensor 136 according to the embodiment is assumed to detect the rod 48 which transmits the displacement which is increased by the lever member 120, without directly detecting the lever member 120 which increases the displacement of the film 118. Since there may be a case where the lever member 120 which comes in contact with the film 118 of the liquid chamber 100 is attached with leaked ink, if the displacement of the lever member 120 can be transmitted to the sensor 136 using the rod 48, it is possible to reduce the risk of contaminating the sensor 136 with ink which is attached to the lever member 120, compared to a case where the lever member 120 is directly detected by the sensor 136. Accordingly, it is possible to prevent the detection accuracy of the sensor 136 from dropping.

In addition, the rod 48 according to the embodiment is urged in the direction where the rod comes in contact with the lever member 120 due to the force of the urging spring 134, and the lever member 120 is assumed to come in contact with the film 118 of the liquid chamber 100 using the urging force thereof. Due to this, since it is not necessary to separately provide an urging member which urges the lever member 120 toward the film 118 so as to be interlocked with the displacement of the film 118, it is possible to simplify the structure of the liquid detection system.

In addition, as described above, the relationship between the urging force A of the urging spring 108 of the liquid chamber 100 and the urging force B of the urging spring 134 of the rod 48 is set to satisfy the expression $A \geq R \times B$, by setting the lever ratio of the lever member 120 (distance D2 between the shaft hole 122 and the contact portion 132/distance D1 between the shaft hole 122 and the convex portion 130>1) to R, and the urging force A of the urging spring 108 of the liquid chamber 100 is set to be larger than the urging force B of the urging spring 134 of the rod 48. For this reason, it is possible to maintain the open state of the lever member 120 by pushing the film 118 to the outside of the liquid chamber 100 due to the urging force A of the urging spring 108, while the ink remains in the ink pack 70. On the other hand, when the ink in the ink pack 70 runs out, the liquid chamber 100 attains a negative pressure, and the film 118 deforms so as to be drawn into the liquid chamber 100. Then the rod 48 causes the lever member 120 to rotate according to the deformation of the film 118, due to the urging force B of the urging spring 134, accordingly, it is possible to maintain the closed state of the lever member 120.

In addition, as described above, when the ink cartridge 40 is installed in the cartridge holder 42, the rod 48 according to the embodiment is assumed to move to the rear side of the cartridge holder 42 against the force of the urging spring 134 by coming in contact with the lever member 120. For this reason, the sensor 136 is able to detect that the ink cartridge 40 has installed, on the basis of the change in light from the shielded state to the transmission state due to the movement of the shielding unit 138 of the rod 48. In this manner, since it is possible to perform the detection of installing of the ink cartridge 40, in addition to the detection of the presence or absence of the ink in the ink pack 70 using one sensor 136, the whole structure of the ink jet printer 10 on which the liquid detection system is mounted can be simplified.

In addition, as described above, the guide hole 124 is provided in the lever member 120 which increases the displacement of the film 118, and when the lever member 120 rotates about the shaft hole 122, the guide pin 128 which is fixed to the ink supply unit 74 moves along the guide hole 124, accordingly, the guide pin is assumed to guide the rotation operation of the lever member 120. In this manner, by regulating the rotation operation of the lever member 120, it is possible to improve the accuracy of detecting the fact that the ink in the ink pack 70 has run out, since it is possible to reliably transmit the displacement of the film 118 which comes in contact with the convex portion 130 of the lever member 120, by appropriately increasing the displacement at a predetermined lever ratio R, to the rod 48 which comes in contact with the contact portion 132.

B. Second Embodiment

Figure 9:
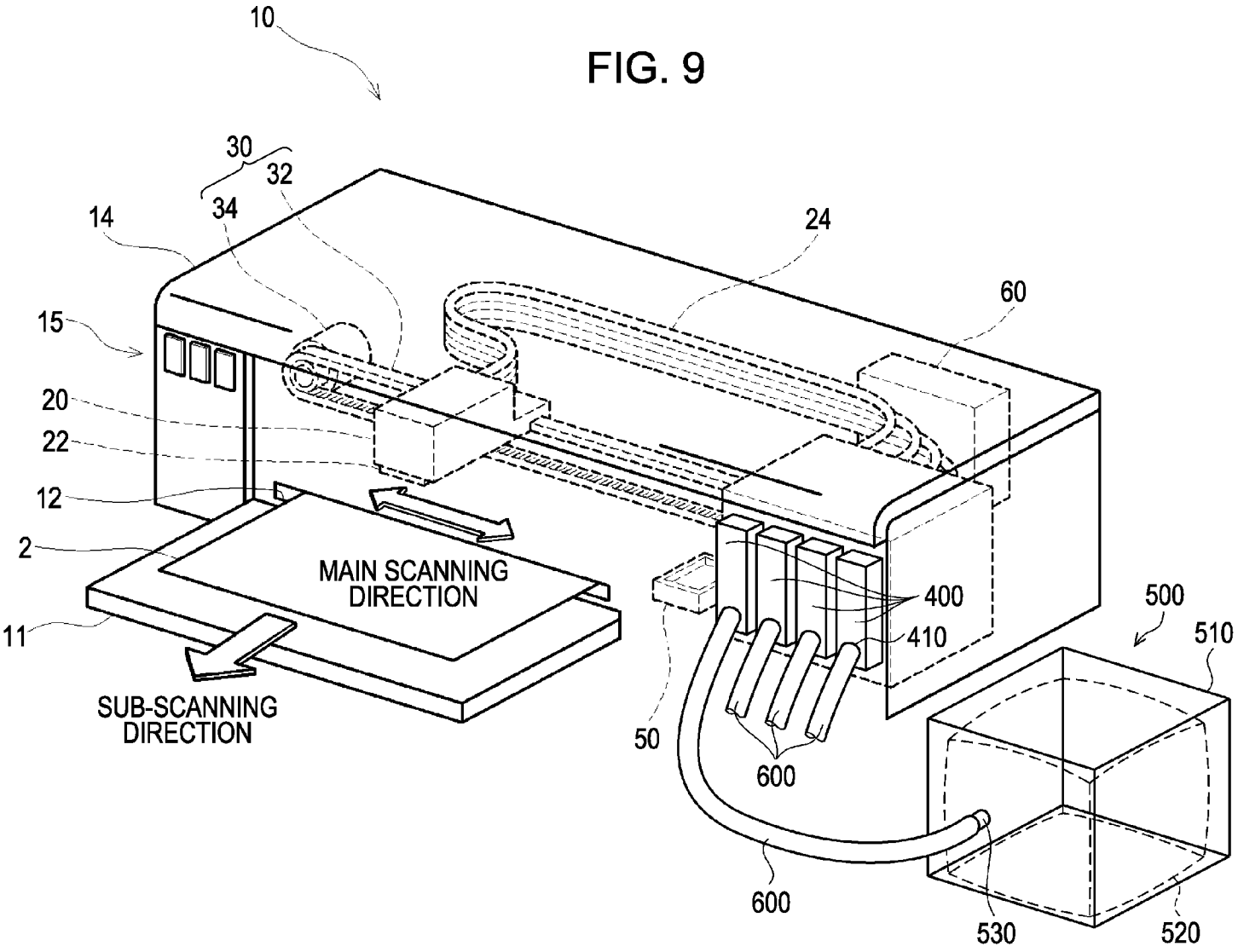
FIG. 9 is an explanatory diagram which shows a schematic configuration of an ink jet printer as a liquid consuming apparatus according to a second embodiment.

Subsequently, an adaptor, and a liquid supply system according to a second embodiment will be described using FIGS. 9 to 13B. FIG. 9 shows an ink jet printer 10 according to the second embodiment which is obtained by modifying a part of the ink jet printer 10 as the liquid consuming apparatus according to the first embodiment shown in FIG. 1. The differences from the first embodiment will be mainly described in below.

Figure 10:
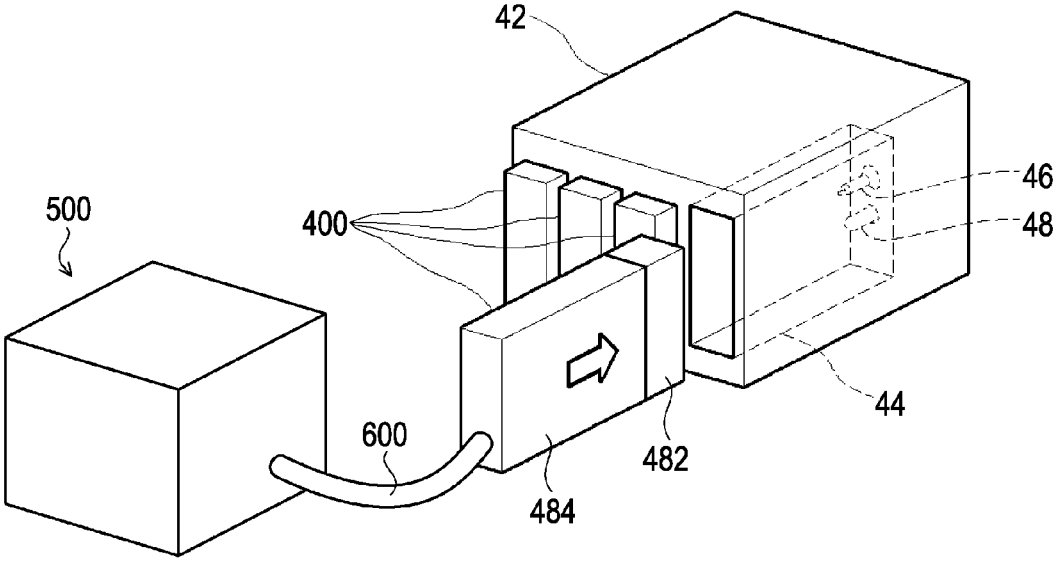
FIG. 10 is a diagram which shows a state where an adaptor according to the second embodiment is installed in the cartridge holder.

In the second embodiment, adaptors 400 are installed in the cartridge holder 42 instead of the ink cartridge 40 according to the first embodiment (refer to FIGS. 9 and 10). The adaptors 400 are provided with ink supply pipe insertion holes 410 which guide flexible ink supply pipes 600 to the inside thereof from the outside. Since the ink supply pipes 600 are extended from the adaptors 400, in a state where the adaptors 400 are installed in the cartridge holder 42, a cartridge replacement cover 13 is unable to be closed. Accordingly, in the ink jet printer 10 according to the second embodiment is not provided with the cartridge replacement cover 13 of the ink jet printer 10 according to the first embodiment. The ink supply pipes 600 are flexible tubes which are formed of silicon rubber, (Ethylene-propylene-diene monomer rubber), vinyl chloride, or the like.

A high capacity external ink tank 500 which stores ink supplied to the ink jet printer 10 is provided outside the ink jet printer 10. In the high capacity external ink tank 500, an external ink pack 520 which is flexible, and is formed of plastic such as polyethylene or the like is received in a case 510 which is formed of cardboard or the like. In the external ink pack 520, it is possible to receive a large amount of ink, compared to the amount of ink which can be received in the ink pack 70 of the ink cartridge 40 according to the first embodiment. A spout 530 which is formed of plastic such as polypropylene or the like is liquid-tightly welded to the inner wall of the external ink pack 520, in the external ink pack 520, and the ink which is stored in the external ink pack 520 is supplied to the ink jet printer 10 through the spout 530.

One end of the ink supply pipe 600 is connected to the spout 530. In addition, the other end of the ink supply pipe 600 is connected to a liquid inlet connector 480 which is provided in an ink supply unit 474 of the adaptor 400, which will be described later. Accordingly, the ink stored in the external ink pack 520 is supplied to the ink jet printer 10 passing through the spout 530, the ink supply pipe 600, the ink supply unit 474, and an ink supply port 478. In FIG. 9, a state is shown, where only one adaptor 400 and one high capacity external ink tank 500 are connected to each other, and other adaptors are omitted in order to simplify the description. However, in practice, all four adaptors 400 shown in FIG. 9 are connected to the high capacity external ink tank 500 which stores ink corresponding to the colors and types.

Figure 11:
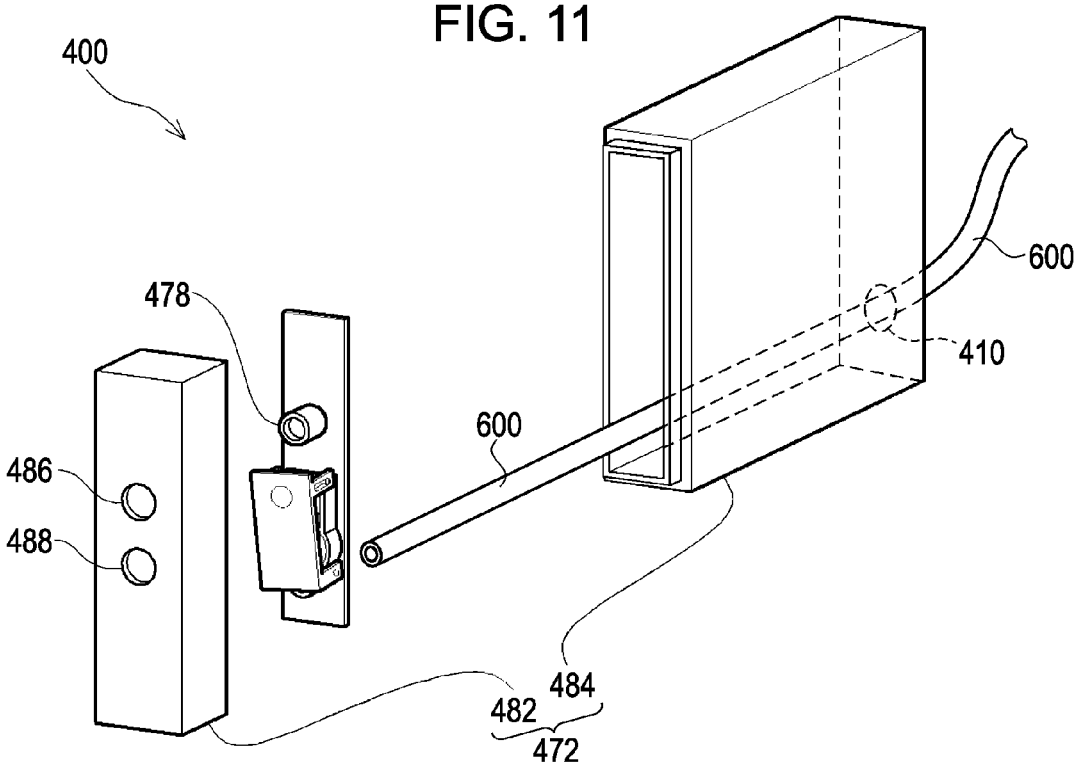
FIG. 11 is an exploded perspective view which shows a configuration of the adaptor according to the second embodiment.

Subsequently, the configuration of the adaptor 400 will be described. FIG. 11 is an exploded perspective view of the ink supply pipe 600 which is inserted to the adaptor 400, and the inside of the adaptor 400. The adaptor 400 is configured by a front case 482, a rear case 484, and the ink supply unit 474, similarly to the ink cartridge 40 according to the first embodiment. Each member which configures the adaptor 400 is common to the member of the ink cartridge 40 according to the first embodiment. As a difference, the ink supply pipe 600 is connected to instead of the ink pack 70 of the ink cartridge 40.

Figure 12:
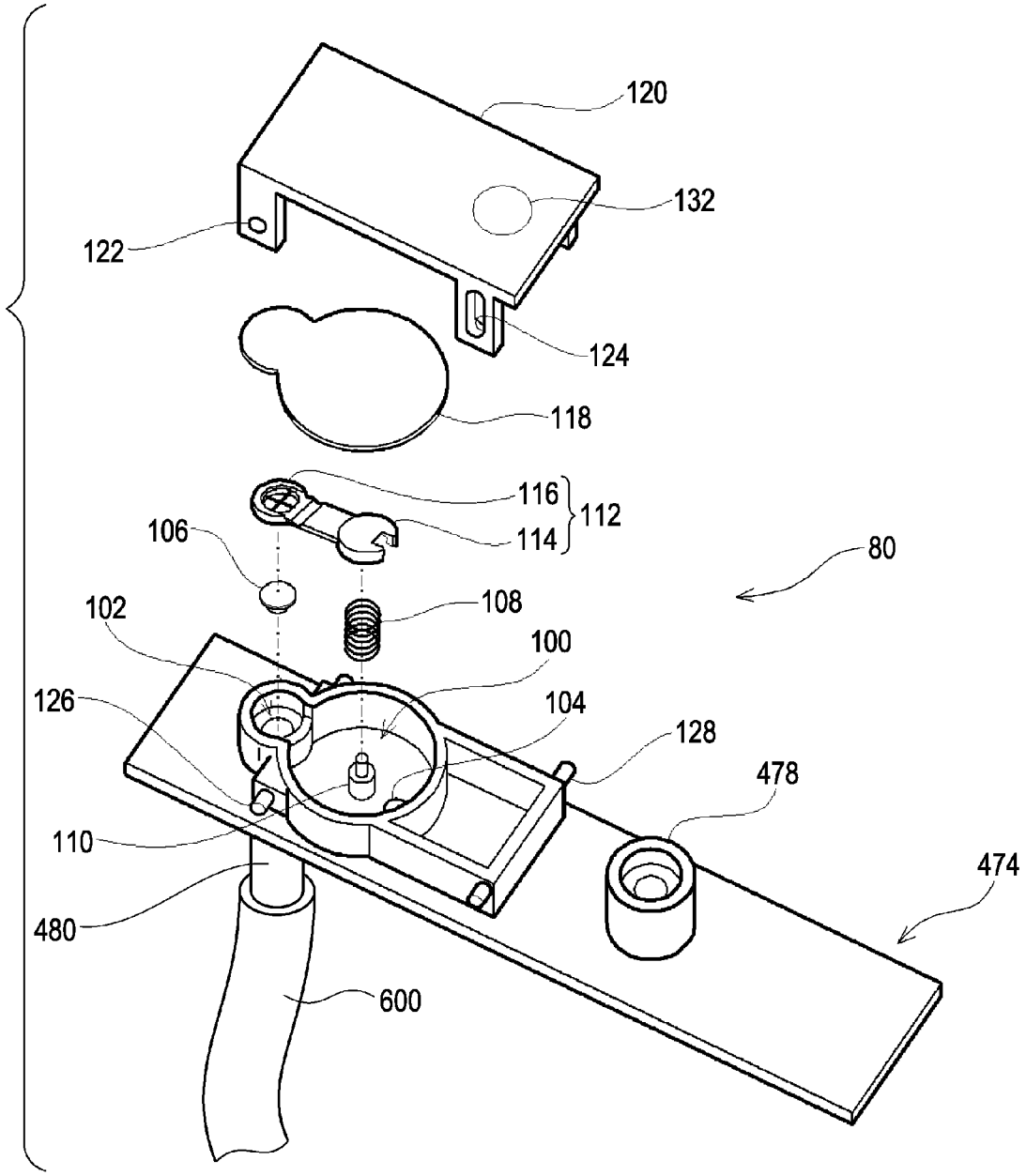
FIG. 12 is an exploded perspective view which shows a configuration of an ink detection mechanism which is installed in the adaptor according to the second embodiment.

Subsequently, the ink supply unit 474 will be described in detail. FIG. 12 is an exploded perspective view which shows the ink supply unit 474 according to the second embodiment. Most parts of the ink supply unit 474 are common to the ink supply unit 74 of the ink cartridge according to the first embodiment. However, since there is no part which corresponds to the ink pack 70 of the ink cartridge 40, in the second embodiment, an ink inlet 76 is not provided. In addition, another difference is that an ink inflow connector 480 for connecting the ink supply pipe 600 is provided, as well. Other configurations, particularly, the configuration of the detection mechanism 80, are the same as that of the first embodiment.

Figure 13A:
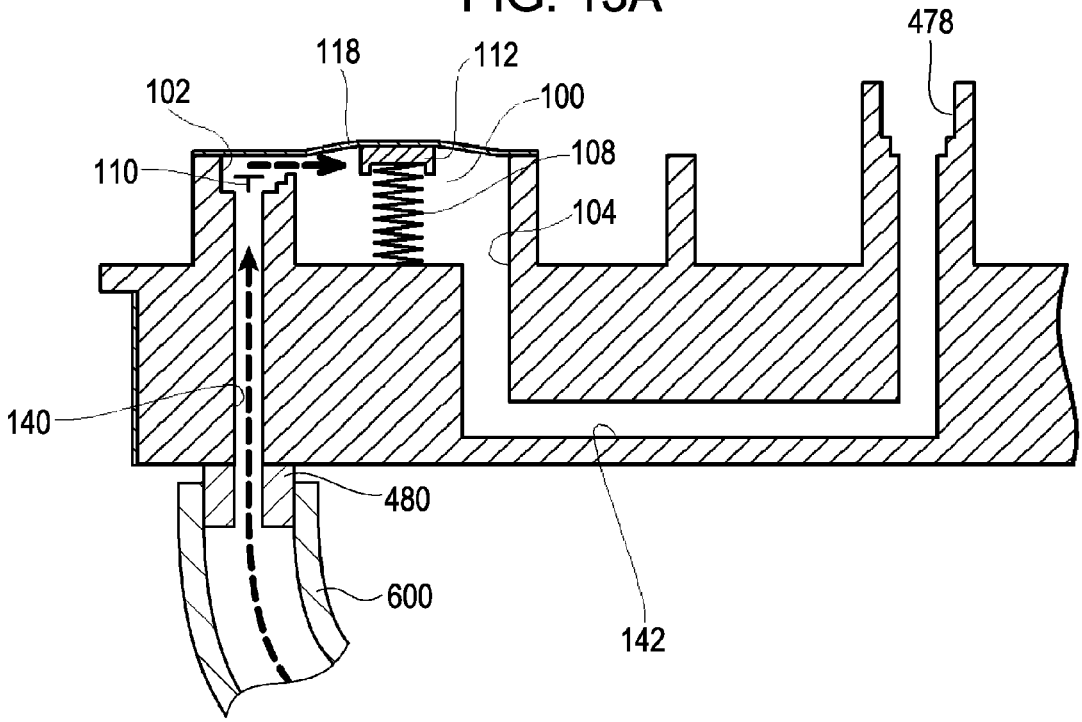
FIGS. 13A and 13B are cross-sectional views which show a state where ink is supplied to an ink supply device through an ink supply pipe.
Figure 13B:
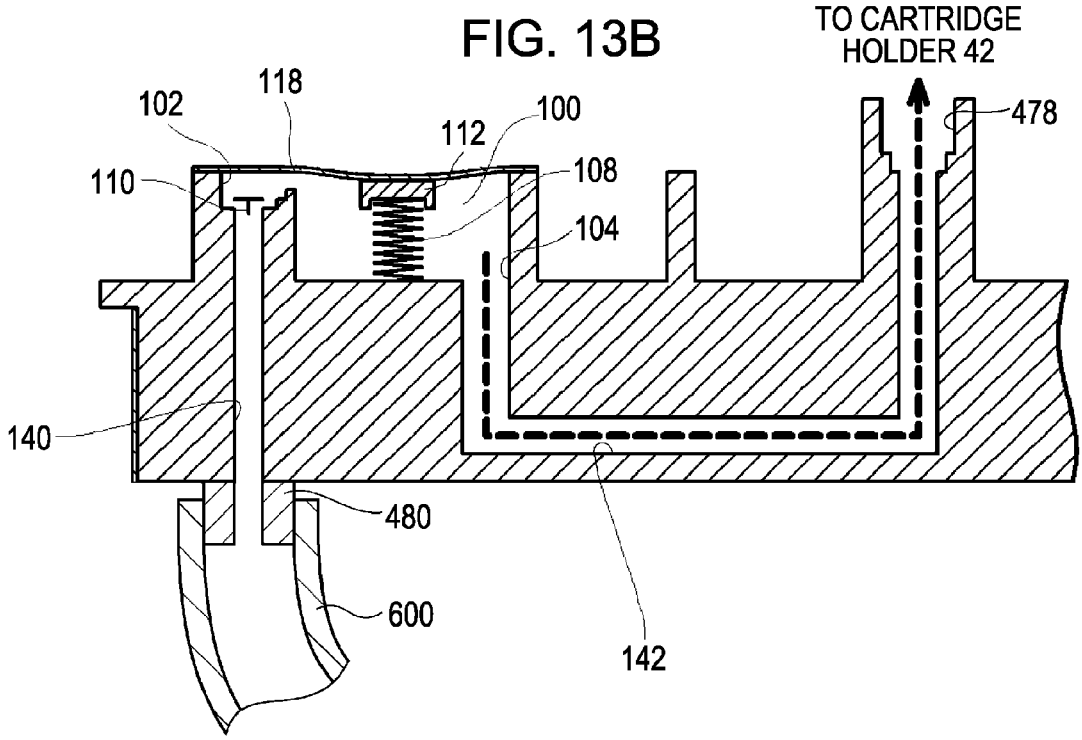

FIGS. 13A and 13B are cross-sectional views which describe a state where the ink is supplied to the ink jet printer 10 from the ink supply pipe 600 through the ink supply unit 474 of the adaptor 400. As described in the first embodiment, a supply pump (not shown) is built into the ink jet printer 10, and the ink is sucked in from the adaptor 400, and is to send to the ejecting head 22 of the ink jet printer 10 in a compressing manner. FIG. 13A shows a state where the supply pump of the ink jet printer 10 is not operated, and FIG. 13B shows a state where the supply pump of the ink jet printer 10 is operated. These states are the same as those of ink supply of the ink supply unit 74 of the ink cartridge 40 according to the first embodiment. In the first embodiment, the ink is supplied to the ink supply unit 74 from the ink pack 70. On the contrary, in the second embodiment, the ink which is stored in the high capacity external ink tank 500 is supplied through the ink supply pipe 600, and this is the only difference. That is, the flow of ink, the situation of the negative pressure in the liquid chamber 100, the situations of deformation of the urging spring 108 and the film 118, or the like when the supply pump of the ink jet printer 10 is not operated, and when the supply pump is operated are the same as those of the first embodiment.

In the second embodiment, a detailed description of the detection of the presence or absence of ink in the high capacity external ink tank 500 is omitted, however, the detection can be performed using the same method as that of the "A-4. Detection of presence or absence of ink in ink cartridge" of the first embodiment. That is, when the ink in the high capacity external ink tank 500 has run out, the ink does not flow into the liquid chamber 100 from the high capacity external ink tank 500, and the negative pressure in the liquid chamber 100 is not relieved. Accordingly, the film 118 maintains the state of being drawn into the liquid chamber 100, as shown in FIG. 8C. In addition, as described in the first embodiment, the shielding unit 138 of the rod 48 is inserted to the sensor 136, and the sensor 136 is in a state of being shielded with light. Accordingly, it is possible to detect that the ink in the high capacity external ink tank 500 has run out.

As described above, since the presence or absence of the ink in the high capacity external ink tank 500 is detected in the second embodiment, as well, similarly to the first embodiment, it is also possible to obtain the same effect as that of the first embodiment, in the second embodiment. Here, the adaptor 400 corresponds to the mounting member of the invention, and the adaptor 400, the ink supply pipe 600, and the high capacity external ink tank 500 correspond to the liquid supply system of the invention.

Hitherto, embodiments of the invention has been described, however, the invention is not limited to all of the above described embodiments, and various changes may be made without departing from the scope of the invention.

For example, in the above described embodiments, the ink was sucked in from the ink supply port 78 of the ink cartridge 40 by operating the supply pump which is built into the cartridge holder 42. However, the ink in the ink pack 70 may be sent in a compressing manner by pressurizing the ink pack 70 from the outside. In addition, in this case, the urging spring 108 of the liquid chamber 100 may be a tension spring which urges the film 118 in a direction where the film is drawn into the liquid chamber 100, instead of the compression spring. The film 118 is pushed to the outside of the liquid chamber 100 due to the pressure of the ink which is sent from the ink pack 70 in a compressing manner, during the ink remains in the ink pack 70. On the other hand, when the ink in the ink pack 70 runs out, the film 118 is drawn into the liquid chamber 100 due to the force of the urging spring 108, since the ink is not supplied, and the pressure in the liquid chamber 100 decreases. It is possible to detect that the ink in the ink pack 70 has run out, similarly to the above described embodiment, by increasing such a displacement of the film 118 using the lever member 120, and transmitting the displacement to the sensor 136 in the cartridge holder 42 using the rod 48.

In addition, in the above described embodiment, the absence of the ink in the ink pack 70 was detected, on the basis of the fact that light in the sensor 136 was shielded even a predetermined time has passed, after the ink is sucked in from the ink supply port 78. However, in contrast to this, by changing the position of the sensor 136, it is possible to detect that the ink in the ink pack 70 has run out, on the basis of the fact that the sensor 136 transmits light in a predetermined time after sucking in the ink from the ink supply port 78. In this case, when the light in the sensor 136 is shielded, in a predetermined time after sucking in the ink from the ink supply port 78, it is assumed that the ink remains in the ink pack 70.

What is claimed is:

1. A liquid detection system which detects the presence or absence of liquid in a liquid container which is detachably mounted with respect to a liquid consuming apparatus, wherein the liquid container includes, a liquid receiving unit which can receive liquid which is consumed in the liquid consuming apparatus;

a liquid chamber to which the liquid flows in from the liquid receiving unit, and has a deforming portion which can deform at a part thereof;

a first urging member which causes an urging force to be applied to the deforming portion, which is opposite to the deformation of the deforming portion due to a negative change in pressure of the liquid chamber which accompanies a supply of the liquid to the liquid consuming apparatus; and a lever member which is rotatably provided about a fulcrum, increases a displacement of the deforming portion which comes in contact with a first contact point at a predetermined lever ratio, and transmits the displacement to a second contact point, and wherein the liquid consuming apparatus includes, a transmitting member which comes in contact with the second contact point of the lever member, and transmits a displacement of the second contact point to the inside of the liquid consuming apparatus;

a sensor which detects the presence or absence of the liquid in the liquid container by detecting the displacement which is transmitted using the transmitting member; and a second urging member which urges the transmitting member in the direction where the transmitting member comes in contact with the lever member, and presses the lever member against the deforming portion using the urging, when the liquid container is installed in the liquid consuming apparatus.

2. The liquid detection system according to claim 1, wherein the liquid container includes a guide unit which guides the lever member when the lever member rotates due to the displacement of the deforming portion.

3. The liquid detection system according to claim 1, wherein the first urging member urges the deforming portion of the liquid chamber in a direction where the deforming portion comes in contact with the lever member, and causes the lever member to rotate in a direction opposite to the second urging member using the urging, and wherein the urging force of the first urging member may be set to be larger than the urging force of the second urging member.

4. The liquid detection system according to claim 3, wherein the ratio of the urging force of the first urging member with respect to the urging force of the second urging member is set to the lever ratio or more.

5. A liquid container which is detachably mounted with respect to a liquid consuming apparatus, comprising:

a liquid receiving unit which can receive liquid which is consumed in the liquid consuming apparatus;

a liquid chamber into which liquid flows from the liquid receiving unit, and has a deforming portion which can deform at a part thereof;

a first urging member which causes an urging force to be applied to the deforming portion, which is opposite to the deformation of the deforming portion due to a negative change in pressure of the liquid chamber which accompanies a supply of liquid to the liquid consuming apparatus; and a lever member which is rotatably provided about a fulcrum, wherein the lever member comes in contact with a transmitting member which is provided in the liquid consuming apparatus, and of which a displacement can be detected using a sensor which is provided in the liquid consuming apparatus, and has a second contact point in which a displacement of the deforming portion which comes in contact with a first contact point of the lever member is increased at a predetermined lever ratio, when being installed in the liquid consuming apparatus.

6. The liquid container according to claim 5, further comprising:

a through hole which guides the transmitting member of the liquid consuming device to the second contact point.

7. A mounting member which is detachably mounted with respect to the liquid consuming apparatus, comprising:

a liquid chamber into which liquid flows from outside, and has a deforming portion which can deform at a part thereof;

a first urging member which causes an urging force to be applied to the deforming portion, which is opposite to the deformation of the deforming portion due to a negative change in pressure of the liquid chamber which accompanies a supply of the liquid to the liquid consuming apparatus; and a lever member which is rotatably provided about a fulcrum, increases a displacement of the deforming portion which comes in contact with a first contact point at a predetermined lever ratio, and transmits the displacement to a second contact point, wherein the lever member comes in contact with a transmitting member which is provided in the liquid consuming apparatus, and of which a displacement can be detected using a sensor which is provided in the liquid consuming apparatus, and has a second contact point in which a displacement of the deforming portion which comes in contact with the first contact point of the lever member is increased at a predetermined lever ratio, when being installed in the liquid consuming apparatus.

8. The mounting member according to claim 7, further comprising:

a connecting unit to which a liquid transport pipe is connected, which transports liquid flowing into the liquid chamber from the outside.

9. A liquid supply system comprising:

a liquid storage unit;

a liquid transport pipe which is connected to the liquid storage unit, and transports liquid which is stored in the liquid storage unit; and the mounting member according to claim 7 which is connected to the liquid transport pipe.

* * * * *